United States Patent [19]

Gali

[11] Patent Number: 5,038,583

[45] Date of Patent: Aug. 13, 1991

[54] GAS EXPANSION MOTOR EQUIPPED AIR CONDITIONING/REFRIGERATION SYSTEM

[76] Inventor: Carl E. Gali, 6414 Faircove Circle, Garland, Tex. 75043

[21] Appl. No.: 452,210

[22] Filed: Dec. 18, 1989

[51] Int. Cl.[5] ..... F25B 1/00

[52] U.S. Cl. ..... 62/498; 62/402

[58] Field of Search ..... 62/116, 401, 402, 498, 62/499, 500, 501, 87

[56] References Cited

U.S. PATENT DOCUMENTS

| | | | |
|---|---|---|---|
| 3,171,268 | 3/1965 | Silver | 62/498 |
| 3,992,891 | 11/1976 | Pocrnja | 62/401 X |
| 4,235,079 | 11/1980 | Masser | 62/116 |
| 4,730,464 | 3/1988 | Lotz | 62/401 |

*Primary Examiner*—Lloyd L. King

*Attorney, Agent, or Firm*—Warren H. Kintzinger

[57] ABSTRACT

A basic air conditioning/refrigeration system charged (filled) with, typically, Nitrogen gas six to ten atmospheres with a specific heat of gas equal to 0.022 B.T.U. per degree F. change per cubic foot per atmosphere when in operation. The system may be run so the gas circulates through the system at 15.5 A. C.F.M., yielding a shaft output of one horse power out of a cooling gas expansion motor. Other refrigerant gases useable in place of Nitrogen are Argon, Helium, Hydrogen, dry air and a forming gas mixture of Nitrogen and Hydrogen in typically an 80% to 20% ratio (Hydrogen would probably not exceed 30% in a forming gas mixture) with all of these remaining in the gaseous state throughout the system as opposed to a freon charged system where freon is expanded from the liquid to gaseous state and compressed back to the liquid state within the system. The gas expansion motor, that may be a multi-cylinder-piston wobble plate motor, has a feed and exhaust valve feeding passageway and cylinder space at piston top dead center with a volumetric ratio of one to a figure in the range of seven to twelve and even on to twenty four times at the bottom of the individual piston stroke. The motor valve is lead set in the 20° to 30° approximate range to initiate feed before piston top dead center and extends through an inlet port of 100° with exhaust valve porting initiated approxiamtely 65° of valve rotation later and then extended through approximately 150° of the rotating value. Output passages and line are considerably larger than freon system pump to expander fluid lines. A system using the gas expander motor includes a cold air flow exchanger, a compressor that has 20 to 30% more displacement than the gas motor and a hot air flow exchanger, and a motor driving both the gas expansion motor and the compressor.

20 Claims, 4 Drawing Sheets

GAS EXPANSION MOTOR EQUIPPED AIR CONDITIONING/REFRIGERATION SYSTEM

Figure 1:
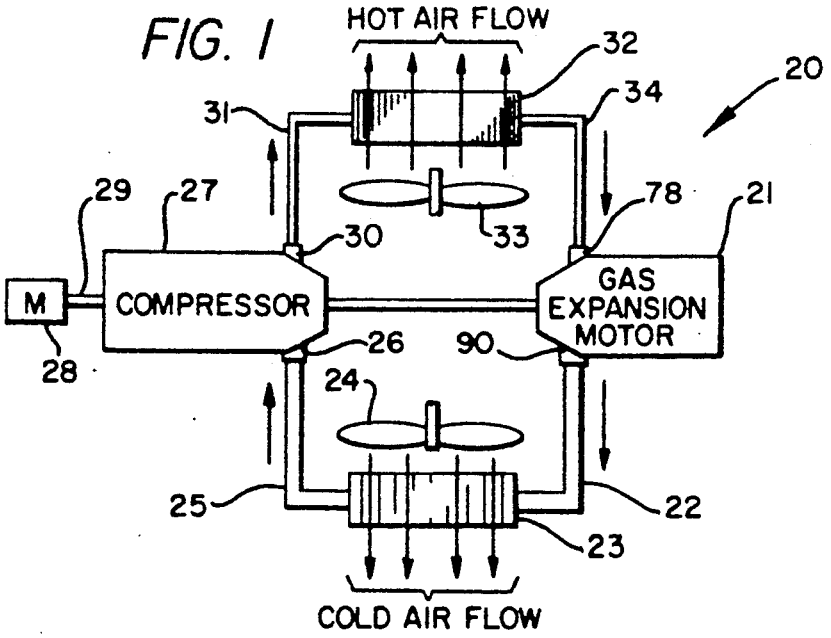

This invention relates in general to air conditioning-/refrigeration systems, and more particularly, to a gas expansion motor equipped air conditioning system also including a compressor, a hotside heat exchanger and a cold side heat exchanger using a gas system charged to many atmospheres, such as ten atmospheres, without the gas being taken to the liquid state through the latent heat of vaporization such as encountered in air conditioning/refrigeration systems using a refrigerant gas such as freon.

Most existing air conditioning/refrigeration systems, and those being built today, are based on the use of a refrigerant such as freon, a member of a family of chlorofluorcarbons (CFC's) banned in the U.S. in 1978 from use in spray cans after the discovery that the gases release ozone-destroying chlorine particularly when they have risen to the ozone layer in the stratosphere under intense radiation from the sun. Destruction of the earth's infrared radiation reducing shield would result in a sizeable increase in skin cancer and, probably, hundreds of thousands of resulting deaths not only for oncoming generations of Americans but also for people around the world. Since freon is a major contributor to the problems any air conditioning/refrigeant system approach dispensing with the use of refrigerant freon and others from the same family and going to a system using gases such as inert Nitrogen, Argon, Helium, Hydrogen, dry air and a forming gas mixture of Nitrogen and Hydrogen would be most advantageous in benefitting our atmosphere from contamination with, for example, Nitrogen being approximately seventy five percent of the air we breathe. While freon is considered cheap, Nitrogen is only about one tenth the cost. Further, safety is a consideration with Nitrogen being quite safe in being most of what we breathe. Power demands of most existing air conditioner/refrigeration systems are more desired with, for example, operation of vehicle air conditioners materially reducing gas mileage so improvements in air conditioner system operating efficiencies with reduced power requirements are important.

It is, therefor, a principal object of this invention to eliminate the use of CFC's such as the refrigerant freon from air conditioning/refrigeration systems by system use of non harmful gases such as inert Nitrogen.

Another object is to minimize release of CFC's to the atmosphere and minimize ozone layer destruction from chlorine released from such gases and improve our environment.

A further object is to provide air conditioner/refrigeration systems safer in operation and for the general public.

Still another object with such air conditioner/refrigerant systems is to improve operating efficiencies and to lower operational power demands.

Another object is to lessen air conditioning power demands in a vehicle and improve vehicle fuel mileage over vehicles equipped with earlier air conditioner systems.

Features of the invention useful in accomplishing the above objects include, in a gas expansion motor equipped air conditioning/refrigeration system, a basic air conditioning/refrigeration system charged (filled) with, typically, Nitrogen gas at six to ten atmospheres with a specific heat of gas equal to 0.022 B.T.U. per degree F. change per cubic foot per atmosphere when in operation. The system may be run so the gas circulates through the system at 15.5 A.C.F.M., yielding a shaft output of one horse power out of a cooling gas expansion motor. Other refrigerant gases usable in place of Nitrogen are Argon, Helium, Hydrogen, dry air and a forming gas mixture of Nitrogen and Hydrogen in typically an 80% to 20% ratio (Hydrogen would probably not exceed 30% in a gas forming mixture) with all of these remaining in the gaseous state throughout the system as opposed to a freon charged system where freon is expanded from the liquid to gaseous state and compressed back to the liquid state within the system. The gas expansion motor, that may be a multi-cylinder-piston wobble plate motor, has a feed and exhaust valve feeding passageway and cylinder space at piston top dead center with a volumetric ratio of one to a figure in the range of seven to twelve times at the bottom of the individual piston stroke. The motor valve is lead set in the 20° to 30° approximate range to initiate feed before piston top dead center and extends through an inlet port of 100° with exhaust valve porting initiated approximately 65° to 90° valve rotation later and then extended through approximately 150° of the rotating valve. Output passages and line are considerably larger than freon system pump to expander fluid lines. A system using the gas expander motor includes a cold air flow exchanger, a compressor that has 20 to 30% more displacement than the gas motor and a hot air flow exchanger, and a motor driving both the gas expansion motor and the compressor. If the compressor and the gas motor are driven together at the same speed the compressor has to have 20 to 30% more displacement but if driven separately they could be of the same displacement with the compressor being driven 20% to 30% faster. In one embodiment the gas expansion motor, a multi-cylinder-piston wobble plate motor, having a feed and exhaust valve connected for drive rotation with the wobble plate of the motor, is combined with the system compressor with compound pistons, a smaller piston end in a smaller cylinder on the motor end and a larger piston end in a larger cylinder for greater compressor displacement. This is with the compound pistons guided in reciprocating motion by the rotating wobble plate in the gas motor/compressor structure.

Specific embodiments representing what are presently regarded as the best modes of carrying out the invention are illustrated in the accompanying drawings.

Figure 2:
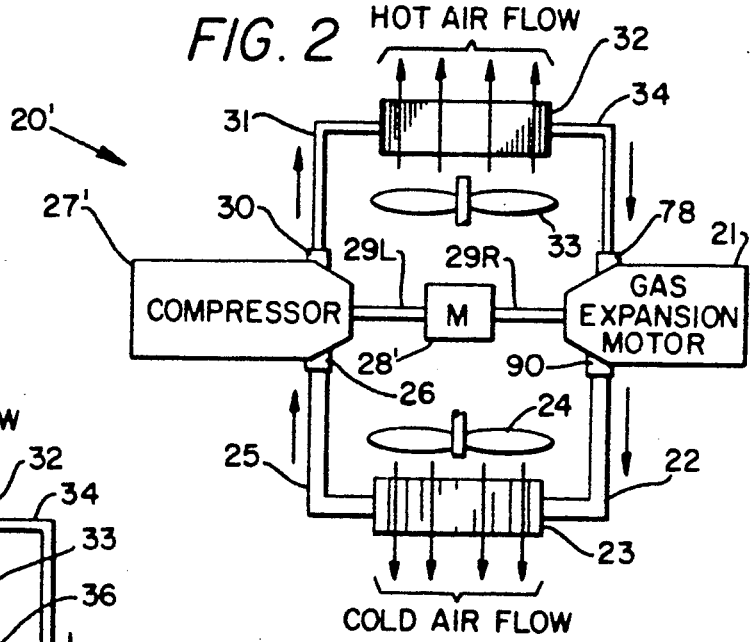
Figure 3:
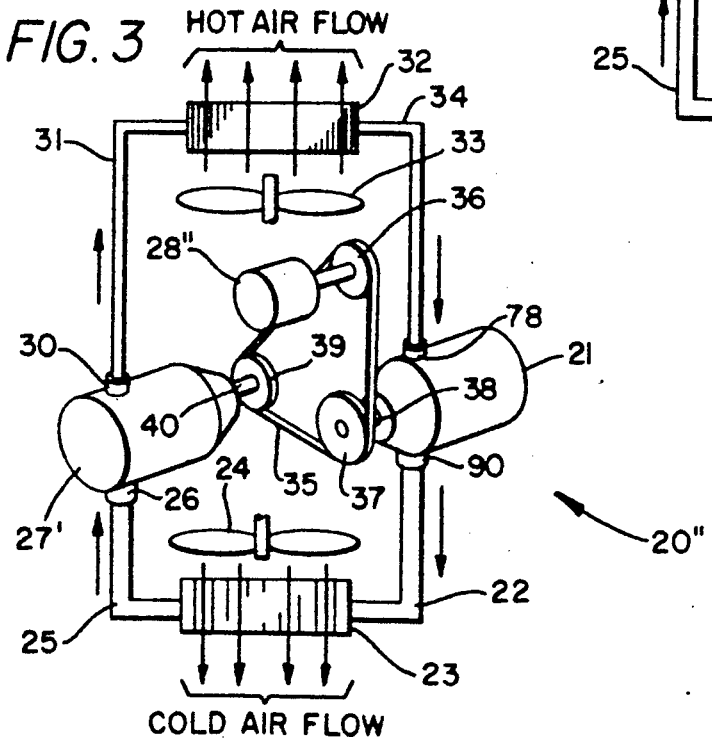
Figure 4:
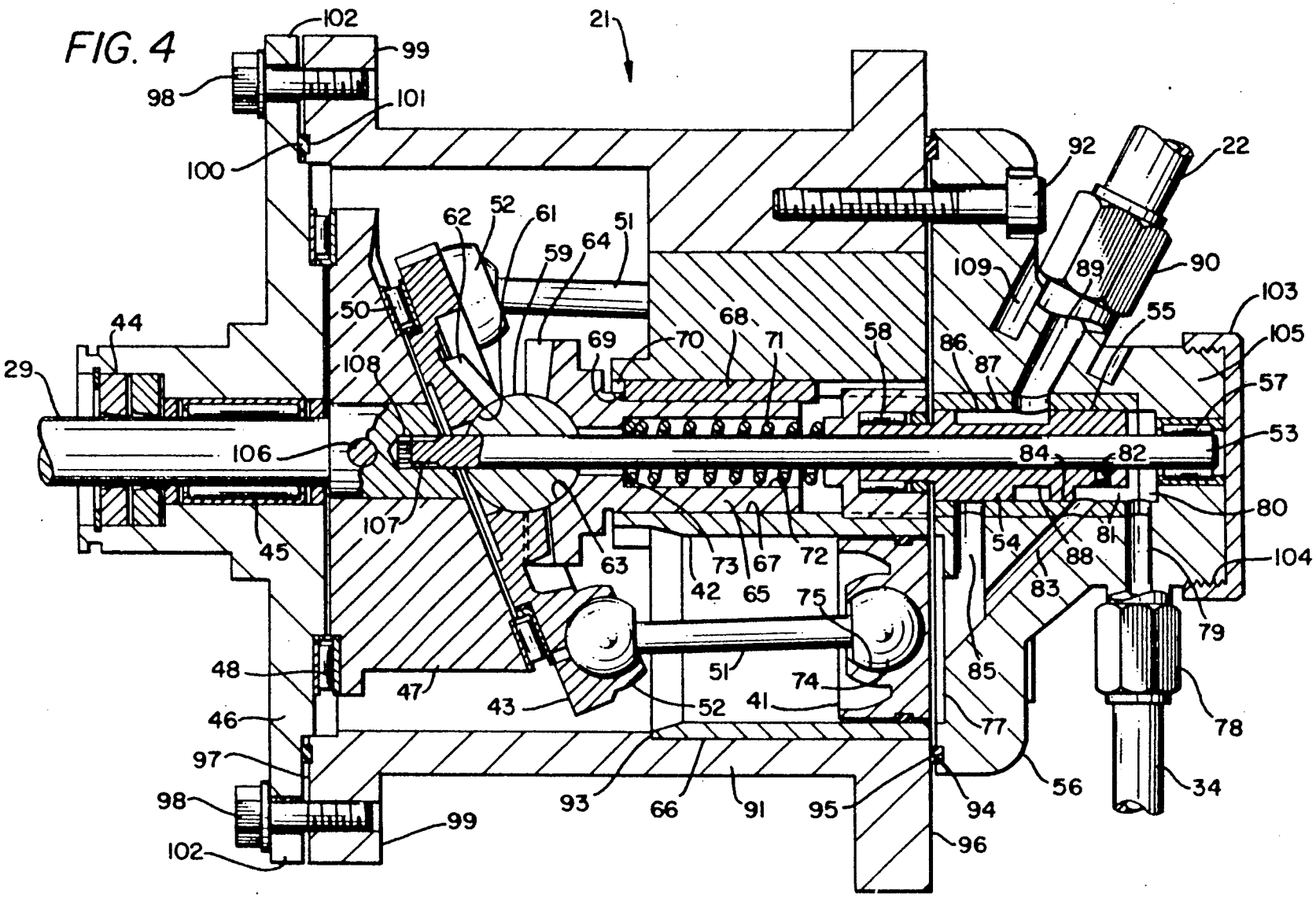
Figure 5:
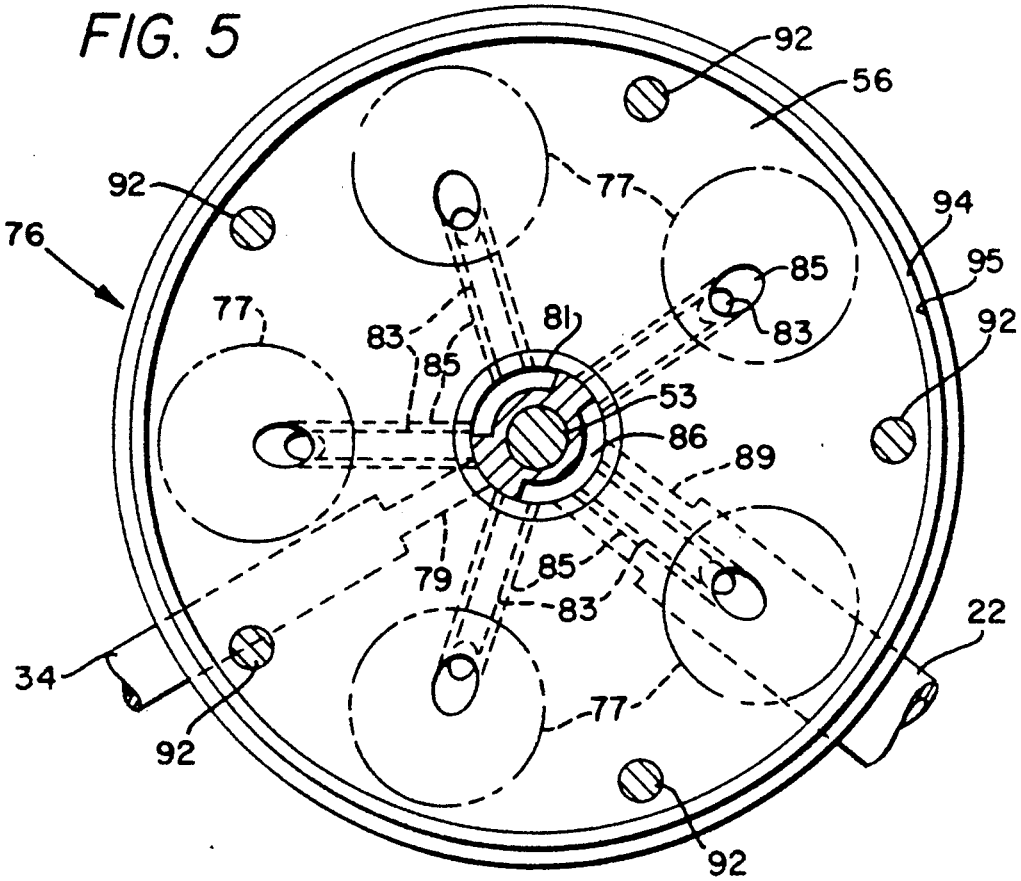
Figure 7:
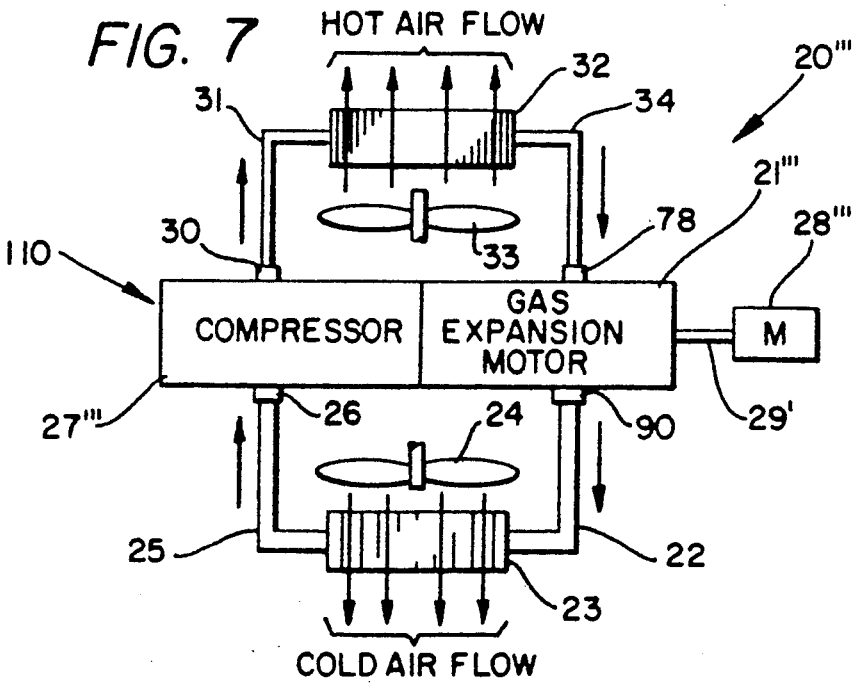
Figure 6:
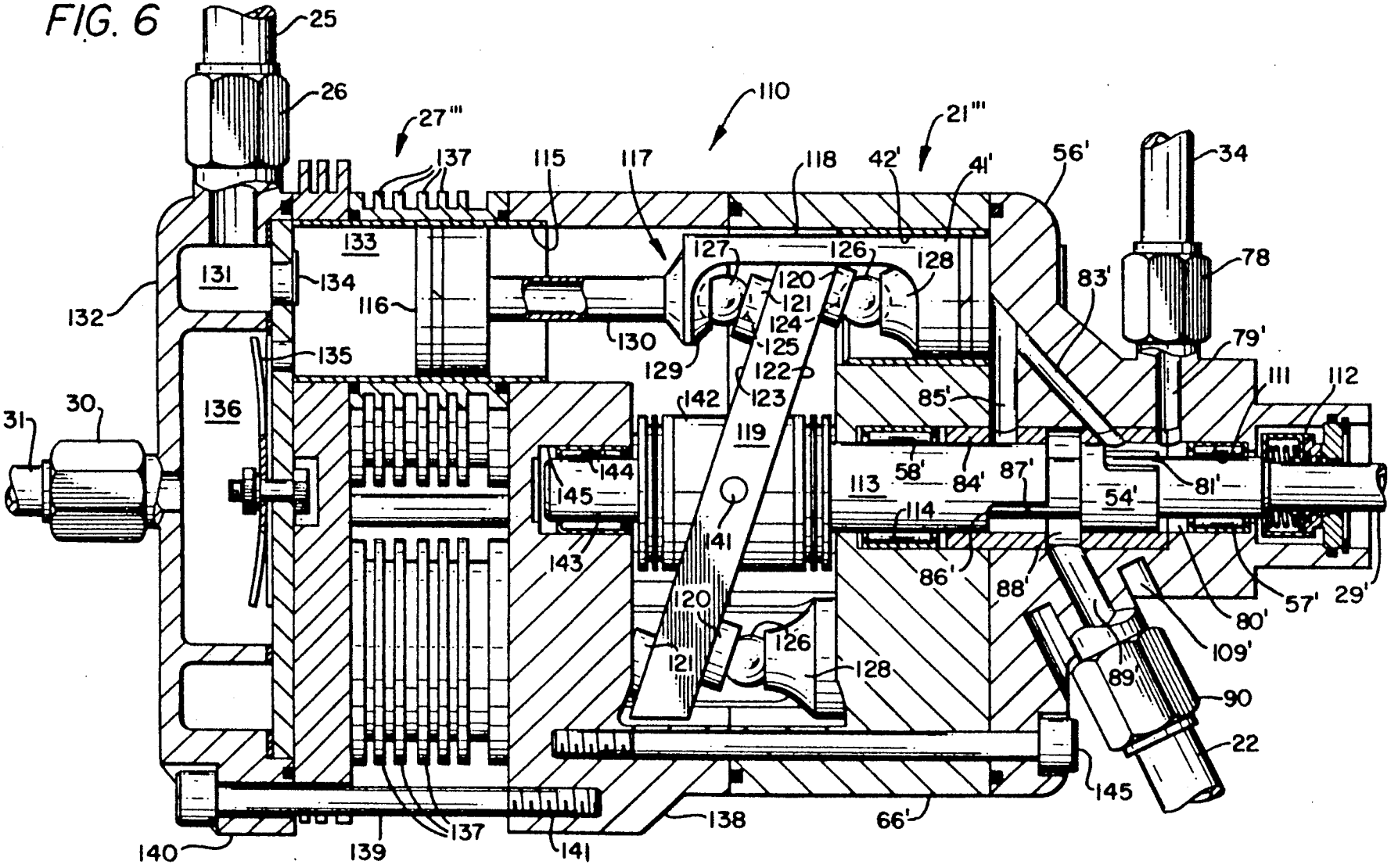

In the drawings:

FIG. 1 represnts a block schematic showing of an air conditioner/refrigeration system equipped with a gas expansion motor with enlarged cold line output through a cold air flow heat exchanger to a motor driven compressor having a smaller line output through a hot air flow heat exchanger on as an input to the gas expansion motor that is also motor driven;

FIG. 2, a block schematic showing of an air conditioner/refrigeration system much like that of FIG. 1 with, however, the drive motor positioned between the gas expansion motor and the system compressor with opposite end drive connections to each;

FIG. 3, a block schematic perspective view showing an electric drive motor pulley and drive belt connected to the gas expansion motor and gas compressor of an air conditioner/refrigerant system having many features in common with the system embodiments of FIGS. 1 and 2;

FIG. 4, a broken away side elevation view of a five cylinder and piston gas expansion motor useable as the gas expansion motor in the air conditioner/refrigeration system embodiment of FIGS. 1, 2 and 3;

FIG. 5, a bottom plan view of the head assembly for the gas expansion motor of FIG. 4, with valve inlet and exhaust port rotational expanse and positioning detailed with valve port of the motor shaft and showing valve to cylinder inlet and exhaust passageway detail;

FIG. 6, a broken away and sectioned side elevation view of a gas expansion motor combined with a system compressor in one assembly having a wobble plate drive and compound piston structures each with a gas expansion motor piston at one end and a compressor piston at the other end; and, FIG. 7, a block schematic showing of an air conditioner/refrigeration system equipped with a gas expansion motor combined with the system compressor such as shown in FIG. 6.

Referring to the drawings:

The air conditioner/refrigeration system 20 of FIG. 1 includes gas expansion motor 21 that has a relatively large cold gas output line 22 input connection to cold air flow heat exchanger 23 with a blower fan 24. A relatively large gas line 25 extends as an output from heat exchanger 23 to the gas input connection 26 of gas compressor 27 that is driven by electric motor 28 via drive shaft 29 that extends through gas compressor 27 and on to a drive connection with gas expansion motor 21. The compressed gas output connection 30 of gas compressor 27 is connected through line 31 as an input to hot air flow heat exchanger 32 with a blower fan 33. Compressed gas line 34 extends from heat exchanger 32 to connection as a high prsssure gas input to gas expansion motor 21. In addition to gas expansion cooling within gas expansion motor 21 and feeding of cooled gas to line 22 and cooling exchanger 23 the gas expansion motor 21 develops useful power output to shaft 29 lessening the torque output requirements imposed on motor 28 in driving gas compressor 27. It should be noted that gas in this system does not change state from the gas state as does freon in a freon gas air conditioner.

With the air conditioner/refrigeration system 20' of FIG. 2 the gas expansion motor 21, the relatively large cold gas output line 22, cold air flow heat exchanger 23, gas line 25, line 31, hot air flow heat exchanger 32 and gas line 34 are the same as in the embodiment of FIG. 1. Compressor 27' is substantially the same, however, electric motor 28' is positioned between the gas expansion motor 21 and the system gas compressor 27' with opposite end shafts 29R and 29L extended, respectively, to each. Here again gas refrigerant is not taken through a change of state in this system.

Referring now to the belt 35 driven air conditioner/-refrigeration system 20" of FIG. 3 components the same as in the embodiments of FIGS. 1 and 2 are numbered the same as a matter of convenience without some of the explanation being repeated again. With the pulley belt 35 drive the electric motor 28" has an output pulley 36 driving belt 35 that runs over pulley 37 on gas expansion motor 21 shaft 38 and on over pulley 39 on system compressor 27' shaft 40 back to electric motor output pulley 36. Please note that compressor pulley 39 is smaller in diameter than gas expansion motor pulley 37 so that with equal size cylinders and equal stroke the compressor, by running faster, attains a greater displacement through flow per unit time in the range of 20% to 30% more than through the gas expansion motor 21.

The gas expansion motor 21, shown in FIGS. 4 and 5, is useable as the gas expansion motor 21 in the system embodiments 20, 20' and 22" of FIGS. 1, 2 and 3. Motor 21 is a five piston 41, five cylinder 42 wobble plate 43 motor. While five pistons and cylinders are used in wobble plate motor 21 a plurality of pistons and cylinders in the range of 3-9 could be used with five being a good choice yielding good smooth balanced operation in use as a gas expansion motor. The output shaft 29 (like shaft 29R in FIG. 2 or shaft 38 in FIG. 3) extends inward through shaft seal structure 44 to and through roller bearing 45, mounted in motor end plate 46, to drive rotor 47 that is supported against annular flat roller bearing 48 mounted on the inside of motor end plate 46. Drive rotor 47 has a slanted face 49 mounting roller bearing 50 upon which non rotatable wobble plate 43 rests for articulating motion consistent with rotation of drive rotor 47 that is driven in rotation by articulation motion of wobble plate 43. Pistons 41 are connected through piston rods 51 to universal movement socket connections 52 that accomodate limited range universal movement encountered with the range of wobble plate 43 articulating motion in driving the rotor 47 in rotation. An output shaft 29 extension 53 that rotates therewith, and with rotor 47, extends to, and mounts, a rotary valve 54 enclosed within valve chamber 55 in cylinder head block 56 with rotary sleeve bearings 57 and 58 above and below the rotary valve 54 for withstanding side gas pressure loadings imposed on the rotary valve 54 while facilitating relative rotation of the valve 54 in cylinder head block 56 valve chamber 55. A centering ball 59 with shaft extension 53 extending through ball opening 60 allowing free relative rotation therebetween, nests in wobble plate opening spherical section surface 61 centered within annular wobble plate gear 62. The centering ball 59 also nests within the center spherical section surface socket 63 of the locking gear 64 for wobble plate 43. The locking gear 64 is mounted on the bottom of tubular extension 65 that extends upward within cylinder block 66 opening 67, and that is held from rotation within opening 67 by key 68 in longitudinal slots 69 and 70 in tubular extension 65 and cylinder block 66. Compression spring 71 around shaft extension 53 and generally within opening 72 within tubular extension 65 is resiliently compressed between the housing of bearing 58 and internal shoulder 73 within tubular extension 65 for holding locking gear 64 in meshed rotation resisting engagement with wobble plate gear 62. Articulative movement of wobble plate 43 as induced by relative rotation of drive rotor 47 rotates the area of engagement between wobble plate gear 62 and locking gear 64. The upper ends of piston rods 51 have spherically shaped ends 74 seated in mated like shaped spherical sockets 75 in the pistons 41 to accomodate pivoting movement imposed on piston rods 51 through the range of wobble plate articulative movement.

Referring also to FIG. 5 the top head assembly 76 includes cylinder head block 56 with cylinder head locations indicated by phantom circles 77. High pressure gas line 34 is connected by fitting 78 to gas intake passage 79, in cylinder head block 56, extended to head intake gas chamber 80 that is in continuous fluid communication with the intake port 81 of rotary valve 54. Valve 54 is mounted on shaft extension 53 with a set screw 82 fixing the valve 54 for rotation with the shaft extension 53 (with it important that the valve 54 be fixed for rotation with the shaft extension 53 it could be keyed to the shaft 53. Valve intake port 81 is rotated into and out of fluid communication with gas intake passages 83 extended through valve sleeve bearing 84 and cylinder head block 56 to respective cylinder head locations 77. Expanded cold gas output passages 85 extend from respective cylinder head locations 77, where they interconnect with gas intake passages 83 through cylinder head block 56 to and through valve sleeve bearing 84 for fluid communication with valve cold expanded gas output port 86 when the valve 54 is in port 86 rotated position therefore. Valve gas output port 86 that is in direct fluid communication, through longitudinal extension 87, with annular cold gas output passage 88 in valve 54 passes gas output to and through exhaust gas passage 89 extended through valve sleeve bearing 84 and cylinder head block 56 to cold gas exhaust line 22 through fitting 90. While FIG. 5 is a bottom plan view of the head assembly 76 the valve showing is a diagramatic showing with inlet port 81 and outlet port 86 shown as if they were at the same level, while they are actually at different levels, to illustrate their rotational extent and relative rotational positioning. Gas valve inlet port 81 extends through an arc, of 100° and then there is an arcuate space of 65° to 90° the start of exhaust port 86 that has an arcuate extent of 150° followed by an arcuate space of 50° to 90° to the start of inlet port 81. The valve 54 is so rotationally positioned and locked on shaft extension 53 as for valve inlet port 81 to initiate opening to an inlet passage 83 twenty two degrees before respective pistons 41 arriving at top dead center. Further, the ratio of the combined volumn of inlet and outlet passages 83 and 85 to each cylinder 42 and space in the cylinder above the piston 41 of that cylinder at top dead center is at ratio to the combined volumetric space total at the bottom of the piston stroke of 1 to a value in the range of 7 to 12. Cylinder head block 52 is fastened down on cylinder block 56 and wobble plate 43 housing 91 by bolts 92 with cylinder block 56 resting on housing internal shoulder 93 and with an annular seal ring 94 within annular head groove 95 resiliently pressed down on housing surface 96. Motor end plate 46 is fastened to housing end face 97 by bolts 98 extended into housing flange 99 and an annular seal ring 100 within annular housing end groove 101 is resiliently pressed against motor end plate annular shoulder 102. An enclosure cap 103 is tightened with threading 104 on cylinder head block 56 extension 105. Shaft 29 is non rotatably pinned to drive motor 47 by pin 106 and shaft extension 53 is connected to drive shaft 29 by splines 107 in opening 108 for rotation therewith. An annular cut opening 109 is provided in cylinder head block 56 around cold exhaust gas passage 89 to minimize heat conduction through metal of block 56 to the gas passage 89.

The gas expansion motor 21''' combined with a compressor 27''' in a common combined package 110 in FIG. 6 is provided for use in the air conditioner/refrigeration system 20''' of FIG. 7 with electric motor 28''' driving the combined gas expansion motor and compressor package 27'''. With this embodiment structure shown in FIG. 6 the drive shaft 29' enters the cylinder head block 56' that encloses an extension of the shaft with an integral valve section 54', in place of a separate valve member such as valve 54 in the FIG. 4 embodiment, surrounded by valve sleeve bearing 84' within cylinder head block 56'. Roller bearing 57' mounted within opening 111 inside seal structure 112 within block 56' supports the shaft 29' above valve section 54' and roller bearing 58' supports shaft 29' extension body 113 within cylinder block 66' opening 114 below the shaft valve section 54' help support the valve section 54' from gas pressure side loadings. The gas expansion motor 21''' and the compressor 27''' combined therewith in the package 110 are both five cylinder-five piston structures with the five cylinders 42' of the gas expansion motor 21''' longitudinally aligned with the five cylinders 115 of compressor 27'''. The five pistons 41' of the gas expansion motor 21''' as a result are in alignment with the five pistons 116 of compressor 27''' and each piston 41' is interconnected by linking structure 117 to the compressor piston 116 aligned therewith. Each linking structure 117 linking aligned pairs of pistons includes an extension 118 of a gas expansion motor piston 41', open toward wobble plate 119 so as to enclose the outer peripheral edge portion of the plate 119 between pads 120 and 121 that freely slide over opposite side surfaces 122 and 123 of the wobble plate 119. Pads 120 and 121 have spherical portion surfaces 124 and 125 for required articulating movement on spherical balls 126 and 127 seated for free articulating motion in sockets 128 and 129. A stainless steel tube 130 interconnects each piston extension 118 and the compressor piston 116 aligned therewith with the stainless steel material of the tubes 130 and the limited metal mass of the tubes minimizing conduction of heat therethrough. Intake gas passage 131 in compressor head 132 is passed to cylinder-piston chamber 133 via reed flapper valve 134 with each down stroke of piston 116 and then with each upstroke of a piston 116 compressed gas passes through reed flapper valve 135 to compressed gas outlet chamber 136 and on out through compressed gas outlet line 31. Each of the compressor cylinders is provided with cooling fins 137, and the compressor head 132, cylinders 115 and cylinder mount block 138 are fastened together by bolts 139 extended through compressor head flange 140 and threaded 141 into cylinder mount block 138. Wobble plate 119 is fixed for rotation with shaft 29' by pin 141 extended therethrough and through enlarged wobble plate mounting portion 142 of the shaft 29' structure and an end shaft extension 143 is supported by roller bearing 144 in opening 145 of cylinder mount block 138. It should be noted that pistons 41' and 116 having the same stroke that the compressor cylinders are of such greater diameter than pistons 41' and cylinders 42' of gas expansion motor 21''' as to have some 20% to 30% greater compressor pumping displacement than the operational displacement of motor 21''' piston and cylinder displacement for properly balanced system operation. Bolts 145 extend through cylinder head block 56', cylinder block 66'; and are threaded into cylinder mount block 138 to hold gas expansion motor 21''' in asssembly with system compressor 27''' in combined package 110. The gas expansion motor valve ports and cylinder head passageways along with cylinders 42' and pistons 41' function the same as their counterparts in the gas expansion motor 21 of FIG. 4.

When the combination gas expansion motor 21''' and system compressor 27''' are brought up to proper operational speed the motor 21''' yields output power that aids in running the system compressor 27''' thereby greatly reducing the power demands imposed on electric motor 28''' (or any other power drive source that may be used for example in a motor vehicle). Thus, many advantages are realized in such an air conditioner/refrigeration system charged with, typically, Nitrogen gas at six to ten atmospheres with a specific heat of gas equal to 0.022 B.T.U. per degree F. change per cubic foot per atmosphere when in operation with the system run so the gas circulates through the system at 15.5 A.C.F.M., yielding a shaft output of one horsepower out of the cooling gas expansion motor. Obviously these air conditioner/refrigeration systems may be size capacity scaled up or down as desired in order to meet various operational capabilities desired. These new air conditioner/refrigeration embodiments in addition to Nitrogen gas are operable with gases including Argon, Helium, Hydrogen, dry air and a forming gas mixture of Nitrogen and Hydrogen in typically an 80% to 20% ratio in systems where the refrigerant gas is not taken through a change of state but remains in the gaseous state through all system stages of operation. Obviously, there may be as much as a ten percent variation in port arc from the port arcs presented and there may be some variance in intake gas porting from the 22° figure presented and still have good working gas expansion motor performance in the various system embodiments described.

Whereas this invention has been described with respect to several embodiments thereof, it should be realized that various changes may be made without departing from the essential contributions to the art made by the teachings hereof.

I claim:

1. A gas expansion motor useable in an air conditioning/refrigeration system using a refrigerant gas charged to a plurality of atmospheres pressure and not taken through a change of state in its movement through the system comprising: a multi piston and cylinder motor; power output means; motion translating means connected to said power output means; piston connection means interconnecting said pistons and said motion translating means; valve means having intake gas porting means and output porting means rotationally displaced in said valve means; a cylinder head block with gas valve to cylinder gas intake passage means and cylinder to valve gas output passage means; said gas intake passage means and said gas output passage means of each cylinder interconnected at the cylinder top in said cylinder head block; with cylinder charge volume at piston top dead center being the total volume of the intake and output passage means of that cylinder plus any space in the cylinder with the piston at top dead center; each piston in said gas expansion motor having a defined stroke length as determined by structural details of the motor; and wherein the ratio of the space of gas in the motor for a cylinder with the piston at top dead center to the bottom of the piston stroke is one to a figure in the range of seven to twelve.

2. The gas expansion motor of claim 1, including gas intake line passage to said valve connective means; cold gas output line passage from said valve with output connective means; and with said output line passage from said valve larger than said gas intake line passage to said valve.

3. The gas expansion motor of claim 2, wherein said cylinder to valve gas output passage means is larger than said gas valve to cylinder gas intake passage means.

4. The gas expansion motor of claim 3, wherein said valve intake porting means rotationally extends through an arc in the range of from eighty degrees to one hundred and twenty degrees; the start of said value intake gas porting means opening to said gas valve to cylinder gas intake passage means is in the range of fifteen to thirty degrees lead setting to initiate feed before piston top dead center; exhaust valve porting positioned for exhaust valve porting fifty to seventy five degrees of arc behind intake passage means porting; and said exhaust valve porting means extends through an arc in the range from one hundred thirty to one hundred seventy degrees.

5. The gas expansion motor of claim 3, wherein said valve gas porting means rotationally extends through an arc of approximately one hundred degrees; the start of said valve intake gas porting means opening to said gas valve to cylinder gas intake passage means being approximately twenty two degrees of arc lead setting to initiate feed before piston top dead center; exhaust valve porting positioned for exhaust valve porting approximately sixty five degrees of arc behind intake passage means porting; and said exhaust valve porting means extends through an arc of approximately one hundred and fifty degrees.

6. The gas expansion motor of claim 1, wherein said valve intake porting means rotationally extends through an arc in the range of from eighty degrees to one hundred and twenty degrees; the start of said valve intake gas porting means opening to said gas valve to cylinder gas intake passage means is in the range of fifteen to thirty degrees lead setting to initiate feed before piston top dead center; exhaust valve porting positioned for exhaust valve porting fifty to seventy five degrees of arc behind intake passage means porting; and said exhaust valve porting means extends through an arc in the range from one hundred thirty to one hundred seventy degrees.

7. The gas expansion motor of claim 1, wherein said valve gas porting means rotationally extends through an arc of approximately one hundred degrees; the start of said valve intake gas porting means opening to said gas valve to cylinder gas intake passage means being approximately twenty two degrees of arc lead setting to initiate feed before piston top dead center; exhaust valve porting positioned for exhaust valve porting approximately sixty five degrees of arc behind intake passage means porting; and said exhaust valve porting means extends through an arc of approximately one hundred and fifty degrees.

8. The gas expansion motor of claim 6, wherein said multi piston and cylinder motor is a wobble plate motor; with said motor translating means including a wobble plate connected by drive connecting means to said power output means in the form of a shaft structure with said valve means having intake gas porting means fixed for rotation therewith.

9. The gas expansion motor of claim 8, wherein said motion translating means is a drive rotor supported for rotative movement by bearing means on the inside of a motor casing end plate; with said drive rotor being pinned to said shaft structure for rotation therewith and having a slanted face over which said wobble plate articulates to match rotative movement of said drive motor slanted face.

10. The gas expansion motor of claim 9, wherein said multi piston and cylinder gas expansion motor is part of an air conditioner/refrigeration system with a cold gas output line larger than a gas input line connected to the motor connecting the cold gas output to a cold air flow heat exchanger for cold gas flow therethrough; gas line means interconnecting said cold air flow heat exchanger and a gas compressor for feeding gas to be compressed thereto; connection of the output of said gas compressor to a hot air flow heat exchanger for cooling of hot compressed gas passed therethrough; and connection of the output of said hot flow heat exchanger to and through said gas input line connected to the gas expansion motor; and with power source drive means drive power .connected to both said compressor and said drive shaft structure of said gas expansion motor.

11. The gas expansion motor of claim 10, wherein said power source drive means is .an electric drive motor drive connected by shaft connection means through said compressor and on through to said gas expansion motor.

12. The gas expansion motor of claim 10, wherein said power source drive means is an electric drive motor having output drive shaft connection out of a first end to said compressor; and having output drive shaft connection out of a second end to said gas expansion motor.

13. The gas expansion motor of claim 10, wherein said power source drive means is drive connected by output shaft mounted pulley and belt that is drive connected by running over a pulley on the shaft structure of said gas expansion motor and on over a shaft mounted pulley of said compressor and back to said power source drive means output shaft mounted pulley.

14. The gas expansion motor of claim 13, wherein the pulley on the shaft structure of said gas expansion motor is larger in diameter than the pulley on the shaft of said compressor so that with equal size cylinders and equal stroke between the compressor and the gas expansion motor the compressor, by running faster, attains a greater displacement through flow per unit time in the range of 20% to 30% more than through the gas expansion motor for properly balanced system operation.

15. The gas expansion motor of claim 8, wherein said motion translating means is a rotational wobble plate mounted at an angle on said gas expansion motor shaft structure with interconnect means fastening said wobble plate for rotation with said shaft structure; piston connection means extended from the pistons of said gas expansion motor to motion guide means on the remote side of said wobble plate from said pistons of said gas expansion motor; said piston connective means extended from pistons being open toward said wobble plate and enclosing the outer peripheral portion of said wobble plate and mounting opposite side articulating sliding pad structures with said sliding pads in free sliding engagement with opposite side surfaces of said wobble plate.

16. The gas expansion motor of claim 15, wherein said motor guide means are compressor pistons in compressor cylinders of like number as the multi pistons and cylinders of said gas expansion motor; and wherein said gas expansion motor and an air conditioner/refrigeration system compressor are assembled together in a common housing structure.

17. The gas expansion motor of claim 16, wherein said sliding pads have spherical portion surfaces for required articulating movement on spherical balls seated for free articulating motion in opposite side wobble plate enclosing sockets of said piston connective means.

18. The gas expansion motor of claim 17, wherein a stainless steel tube connected to each compressor piston as part of said piston connective means by resistance of said metal and the limited metal mass of said tubes minimizes conduction of heat therethrough.

19. The gas expansion motor of claim 17, wherein with pistons of said gas expansion motor being each in alignment with and joined to a piston of said compressor that the stroke of compressor pistons and gas expansion motor pistons is the same; and that said compressor cylinders and pistons are of such greater diameter than the pistons and cylinders of said gas expansion motor as to have 20% to 30% greater compressor pumping displacement than the operational gas expansion motor piston and cylinder displacement for properly balanced system operation.

20. A gas expansion motor and compressor packaged together for use in an air conditioning/refrigeration system using a refrigerant gas charged to a plurality of atmospheres pressure and not taken through a change of state in its movement through the system comprising: a multi piston and cylinder gas expansion wobble plate motor sharing the wobble plate drive with a system compressor assembled together in a common housing structure in a system using a gas from the family of gases including Nitrogen, Argon, Helium, Hydrogen, dry air and a forming gas mixture of Nitrogen and Hydrogen in approximately an eight to two ratio charged to a plurality of atmospheres; gas expansion motor and compressor drive shaft means extended to the exterior of said common housing structure; valve means on said drive shaft means having intake gas porting means and output porting means rotationally displaced in said valve means; a cylinder head block with gas valve to cylinder gas intake passage means and cylinder to valve gas output passage means; said gas intake passage means and said output gas passage means of each cylinder interconnected at the cylinder top in said cylinder head block; with cylinder charge volume at piston top dead center being the total volume of the intake and output passage means of that cylinder plus any space in the cylinder with the piston at top dead center; each piston in said gas expansion motor having a defined stroke length as determined by structural details of the motor; and wherein the ratio of the space of gas in the motor for a cylinder with the piston at top dead center to the bottom of the piston stroke is one to a figure in the range of seven to twelve; wherein said valve intake porting means rotationally extends through an arc in the range of from eighty degrees to one hundred and twenty degrees; the start of said valve intake gas porting means opening to said gas valve to cylinder gas intake passage means is in the range of fifteen to thirty degrees lead setting to initiate feed before piston top dead center; exhaust valve porting positioned for exhaust valve porting fifty to seventy five degrees of arc behind intake passage means porting; and said exhaust valve porting means extends through an arc in the range from one hundred thirty to one hundred seventy degrees; with a rotational wobble plate mounted at an angle on said gas expansion motor drive shaft means with interconnect means fastening said wobble plate for rotation with said drive shaft means; piston connection means extended from the pistons of said gas expansion motor to compressor pistons in compressor cylinders of like number as the multi pistons and cylinders of said gas expansion motor; said piston connection means being open toward said wobble plate and enclosing the outer peripheral portion of said wobble plate and mounting opposite side articulating sliding pad structures with said sliding pads in free sliding engagement with opposite side surfaces of said wobble plate; said sliding pads have spherical portion surfaces for required articulating movement on spherical balls seated for free articulating motion in opposite side wobble plate enclosing sockets of said piston connective means; and wherein with pistons of said gas expansion motor being each in alignment with and joined to a piston of said compressor that the stroke of compressor pistons and gas expansion motor pistons is the same; and that said compressor cylinders and pistons are of such greater diameter than the pistons and cylinders of said gas expansion motor as to have 20% to 30% greater compressor pumping displacement than the operational gas expansion motor piston and cylinder displacement for properly balanced system operation.

* * * * *